United States Patent [19]

Atwood

[11] Patent Number: 4,997,549

[45] Date of Patent: Mar. 5, 1991

[54] AIR-SPARGED HYDROCYCLONE SEPARATOR

[75] Inventor: Ronald L. Atwood, Farmington, Utah

[73] Assignee: Advanced Processing Technologies, Inc., Salt Lake City, Utah

[21] Appl. No.: 409,385

[22] Filed: Sep. 19, 1989

[51] Int. Cl.[5] ..... B03D 1/24; B03D 1/14

[52] U.S. Cl. ..... 209/164; 209/211; 209/170; 261/122; 210/221.2; 210/512.1

[58] Field of Search ..... 209/164, 170, 211; 210/221.2, 512.1, 788; 261/122

[56] References Cited

U.S. PATENT DOCUMENTS

| | | | |
|---|---|---|---|
| 1,149,463 | 8/1915 | Pardee . | |
| 1,420,138 | 6/1922 | Peck . | |
| 1,420,139 | 6/1922 | Peck . | |
| 1,869,732 | 8/1932 | Asselstine . | |
| 1,952,727 | 3/1934 | Ralston | 209/170 |
| 2,054,643 | 9/1936 | Tucker | 209/170 |
| 2,354,311 | 7/1944 | Harlow | 209/144 |
| 2,532,885 | 12/1950 | Bergés | 92/28 |

(List continued on next page.)

FOREIGN PATENT DOCUMENTS

| | | | |
|---|---|---|---|
| 274463 | 5/1963 | Australia . | |
| 275365 | 8/1964 | Australia . | |
| 274774 | 4/1965 | Australia . | |
| 414524 | 3/1968 | Australia . | |
| 1178382 | 11/1982 | Canada . | |
| 0029553 | 6/1981 | European Pat. Off. . | |
| 957653 | 1/1957 | Fed. Rep. of Germany | 209/170 |
| 226259 | 3/1943 | Switzerland . | |
| 545385 | 3/1977 | U.S.S.R. . | |
| 751437 | 7/1980 | U.S.S.R. . | |
| 1183185 | 4/1983 | U.S.S.R. | 209/170 |
| 1005479 | 9/1965 | United Kingdom | 209/170 |
| 1177176 | 1/1970 | United Kingdom . | |
| 1500117 | 2/1978 | United Kingdom . | |
| 1175621 | 8/1964 | Fed. Rep. of Germany . | |
| 2748478 | 5/1978 | Fed. Rep. of Germany . | |
| 2812105 | 9/1979 | Fed. Rep. of Germany . | |
| 998240 | 1/1952 | France . | |
| 1022375 | 3/1953 | France . | |
| 1004960 | 10/1954 | France . | |
| 1249814 | 3/1961 | France . | |
| 1356704 | 7/1964 | France . | |
| 2263036 | 10/1975 | France . | |

*Primary Examiner*—Stanley Silverman
*Assistant Examiner*—Thomas M. Lithgow
*Attorney, Agent, or Firm*—Workman, Nydegger & Jensen

[57] ABSTRACT

An apparatus and method for separating hydrophilic particles from a fluid suspension containing both hydrophilic and hydrophobic particles. A generally cylindrical separation vessel includes tangential inlet and outlet ports. The fluid suspension is introduced into the separation vessel through the inlet port to circulate around the inner surface of the separation vessel in a forced vortex swirl flow. Air sparged through a porous wall portion of the side walls of the separation vessel forms air bubbles to which attach hydrophobic particles in particle/bubble aggregates. These migrate as a froth towards the axial center of the separation vessel where they are discharged at the upper end thereof. A froth washing tube having an open end proximate to the upper end of the separation vessel discharges pressurized water thereinto. A deflector located opposite the open end of the froth washing tube causes the momentum of the pressurized water discharged to be directed radially outward from the open end of the froth washing tube in a spray that passes through the froth toward the side walls of the separation vessel, removing hydrophilic particles entrained in the froth. Optionally, the froth is discharged from the separation vessel through a vortex finder, and a froth pedestal is located within the lower end of the separation vessel.

44 Claims, 3 Drawing Sheets

U.S. PATENT DOCUMENTS

| | | | |
|---|---|---|---|
| 2,538,870 | 1/1951 | Hunter | 196/19 |
| 2,757,581 | 8/1956 | Freeman et al. | 92/28 |
| 2,816,490 | 12/1957 | Boadway et al. | 92/28 |
| 2,829,771 | 4/1958 | Dahlstrom | 209/211 |
| 2,849,930 | 9/1958 | Freeman et al. | 92/28 |
| 2,879,889 | 3/1959 | Rakowsky | 209/173 |
| 2,917,173 | 12/1959 | Rakowsky | 209/172.5 |
| 3,052,361 | 9/1962 | Whatley et al. | 210/512 |
| 3,130,157 | 4/1964 | Kelsall et al. | 210/512 |
| 3,219,186 | 11/1965 | Polhemus et al. | 209/172.5 |
| 3,339,730 | 9/1967 | Boutin | 209/170 |
| 3,349,548 | 10/1967 | Boyen | 55/457 |
| 3,371,779 | 3/1968 | Hollingsworth | 209/170 |
| 3,391,787 | 7/1968 | Salomon | 210/84 |
| 3,426,513 | 2/1969 | Bauer | 55/459 |
| 3,443,932 | 5/1969 | Melin et al. | 75/101 |
| 3,452,870 | 7/1969 | Katsuta et al. | 210/94 |
| 3,489,680 | 1/1970 | Snavely, Jr. | 210/23 |
| 3,489,686 | 1/1970 | Parran, Jr. | 252/106 |
| 3,557,956 | 1/1971 | Braun et al. | 210/84 |
| 3,615,008 | 10/1971 | Alpha | 209/139 A |
| 3,687,286 | 8/1972 | Weiss | 209/211 |
| 3,759,385 | 9/1973 | Pouillon | 209/165 |
| 3,764,005 | 10/1973 | Zemanek | 209/211 |
| 3,785,489 | 1/1974 | Frykhutt | 209/211 |
| 3,802,570 | 4/1974 | Dehne | 210/304 |
| 3,844,414 | 10/1974 | Jordison | 209/467 |
| 4,005,998 | 2/1977 | Gorman | 55/84 |
| 4,031,006 | 6/1977 | Ramirez et al. | 210/44 |
| 4,076,507 | 2/1978 | Hauberg | 55/1 |
| 4,097,375 | 6/1978 | Molitor | 210/23 H |
| 4,165,841 | 8/1979 | Musselmann et al. | 241/46.02 |
| 4,208,276 | 6/1980 | Bahr | 209/168 |
| 4,212,730 | 7/1980 | Brooks et al. | 209/168 |
| 4,214,982 | 7/1980 | Pfalzer | 209/211 |
| 4,216,095 | 8/1980 | Ruff | 210/512 |
| 4,279,741 | 7/1981 | Campbell | 209/44 |
| 4,279,743 | 7/1981 | Miller | 209/170 |
| 4,397,741 | 8/1983 | Miller | 209/170 |
| 4,399,027 | 8/1983 | Miller | 209/170 |
| 4,597,859 | 7/1986 | Beck | 209/211 |
| 4,629,555 | 12/1986 | Colman | 209/211 |
| 4,744,890 | 5/1988 | Miller | 209/170 |
| 4,750,994 | 6/1988 | Schneider | 209/170 |
| 4,838,434 | 6/1989 | Miller | 209/170 |
| 4,851,036 | 7/1989 | Anthes | 209/170 |

OTHER PUBLICATIONS

A. Bahr et al., "The Development and Introduction of a New Coal Flotation Cell," *Report of the Fourteenth International Mineral Processing Congress* (Oct. 17–23, 1982).

Bradley, D., "Patent Review," *The Hydrocyclone*, Chapter 14 (1965).

Brayshaw, M., *The Sharpening of the Hydrocyclone Efficiency Curve by Modification of the Flow Field Vorticity Function Using a Numerical Model*, (1978).

Deurbrouck, A. W., *Performance Characteristics of Coal-Washing Equipment: Dense-Medium Cyclones*, U.S. Dept. of Interior (1972).

Deurbrouck, Albert, *Performance Characteristics of Coal-Washing Equipment: Hydrocyclones*, U.S. Dept. of Interior (1974).

Foreman, William E., "The Flotation of Slimes", *Canadian Mining Manual*, (1961).

Fuerstenau, M. C., ed. *Flotation*, pp. 1246–1253 (1976).

Jowett, A., "Formation and Distruption of Particle-Bubble Aggregates in Flotation", *Fine Particles Processing*, Chap. 37 (1980).

Miller, J. D., *The Concept of an Air Sparged Hydrocyclone*, (1980).

Miller, J. D. et al., *Fine Coal Flotation in a Centrifugal Field with an Air Sparged Hydrocyclone*, Society of Mining Engineers (1981).

Minerals Separation Corporation product brochure, *A Proven Concept in Mineral Processing and Coal Washing* (date unkonwn).

Richard Mozley Limited, product brochure, *Hydrocyclone Assemblies* (date unknown).

O'Brien, Ellis, J., "Water-Only Cyclones: Their Functions and Performance", *Coal Age* (1976).

Sands, Paul et al., *Performance of the Hydrocyclone as a Fine-Coal Cleaner*, U.S. Dept. of the Interior (1968).

Trawinski, H., "Theory, Applications, and Practical Operation of Hydrocyclones, " *E/MJ Operationg Handbook of Mineral Processing*, pp. 146–158 (1976).

Trawinski, H. F., "The Application of Hydrocyclones as Versatile Separators in Chemical and Mineral Industries," (1980).

Ye, Y. et al., "Development of the Air Sparged Hydrocyclone—A Swirl-Flow Flotation Column," International Symposium on Column Flotation, Society of Mining Engineers (1988).

AIR-SPARGED HYDROCYCLONE SEPARATOR

BACKGROUND

1. Field of the Invention

The present invention relates to apparatus and methods for use in the flotation separation of particles from a fluid particulate suspension. More particularly, the present invention relates to air-sparged hydrocyclone flotation separators wherein hydrophobic particles in the fluid suspension are removed therefrom in a foam.

2. The Prior Art (a) Flotation Systems

Flotation is a process in which one or more specific particulate constituents of a slurry or suspension of finely dispersed particles become attached to gas bubbles to enable separation of those constituents from the others of the slurry or suspension. The buoyancy of the particle/bubble aggregate formed by the adhesion of the gas bubble to a particle in the slurry is such that the aggregate rises to the surface of the separation vessel, where it may be then separated from the remaining particulate constituents which are yet in the aqueous phase of the suspension.

Flotation techniques can be applied where conventional gravity separation techniques are difficult to apply or not economical. Indeed, flotation has supplanted gravity separation methods in solving a number of separation problems. Originally, flotation was used to separate sulphide ores of copper, lead, and zinc from associated gangue mineral particles. Flotation is now also used for concentrating nonsulphide ores, for cleaning coal, for separating salts from their mother liquors, and for recovering elements, such as sulphur and graphite.

During the past two decades, the application of flotation technology to mineral recovery in the United States has increased at an annual rate of about 7.4%. Present flotation installations in the United States alone are capable of processing almost two million (2,000,000) tons of material per day.

The preferred method for removing the floated constituent of a fluid suspension of particles is to form a froth or foam of the collected particle/bubble aggregates. The froth can then be removed from the top of the suspension. This process, which may be conducted as a continuous process is called froth flotation. The effectiveness of froth flotation is enhanced by the introduction into the separation vessel of voluminous quantities of small bubbles, typically in the range of about 0.1 to about 2 millimeters in diameter.

In conventional processes, the success of flotation has depended upon controlling conditions in the particulate suspension so that small air bubbles are selectively attached to one or more particle constituents, while not being attached to the other particle constituents of the suspension. To achieve this selectivity, the slurry or particulate suspension is typically treated by the addition of small amounts of known chemicals or flotation enhancing regents which selectively render one or more of the constituents in the particulate suspension hydrophobic. Chemicals which render hydrophobic a particulate constituent which is normally less hydrophobic or even hydrophilic, are commonly referred to as "collectors," while those that increase the hydrophobicity of a somewhat hydrophobic particulate constituent are referred to as "promoters."

Treatment with a collector or promoter causes those constituents rendered hydrophobic to be repelled by the aqueous environment and attracted to the air bubbles therein. The hydrophobic nature of the surface of these constituents enhances the attachment of air bubbles to the hydrophobic constituents. Thus, control of the surface chemistry of particulate constituents by the addition of flotation enhancing reagents, such as collectors or promoters, allows for the selective formation of particle/bubble aggregates with respect to those constituents.

Other chemicals or flotation enhancing reagents may be used to help create the froth phase for the flotation process. Such chemicals are commonly referred to as "frothers." The most common frothers are short chain alcohols, such as methyl isobutyl carbinol, pine oil, and cresylic acid. Important criteria related to the choice of an appropriate frother include the desired solubility and collecting properties of the froth, such as its toughness, texture, and breakage characteristics. The size, number, and stability of the bubbles during flotation may be optimized at a certain frother concentration. An appropriate frother thus ensures that the froth will be sufficiently stable to sustain the particle/bubble aggregates through removal as a flotation product. Frequently the mixture of desired mineral product and other entrained minerals which are present in the froth is referred to as a concentrate. A proper froth should allow for the drainage of water and for the removal of misplaced hydrophilic particles from the froth.

A complete flotation process is thus conducted in several steps. First, a slurry is prepared containing from about five percent (5%) to about forty percent (40%) by weight of solids in a fluid, usually water. Second, the necessary flotation enhancing reagents are added and agitated with the slurry to distribute the reagents on the surface of the particles targeted to be removed by flotation. Third, the treated slurry is aerated in a separation vessel by agitation in the presence of a stream of air or by distributing the air in fine streams as bubbles through the slurry to produce a froth of particle/bubble aggregates involving the target particles. Finally, the target particles are withdrawn from the top of the cell as concentrate or flotation product. The remaining solids and water are discharged from the bottom of the separation vessel.

One of the problems with conventional flotation methods is the lengthy slurry retention time required in the separation vessel of at least two minutes to achieve successful separation. Relatively long retention times limit plant capacity and necessitate the construction of extremely large equipment at the expense of floor space and capital.

(b) Cyclonic Separators

Cyclonic separators utilize fluid pressure energy to create rotational fluid motion. This rotational motion causes relative movement of the particles suspended in the fluid, thereby permitting separation of particles, one from another or from the fluid in the manner of a centrifuge. These devices are occasionally referred to merely as hydrocyclones.

The rotational fluid motion is produced by the injection of fluid under pressure into a separation vessel. At the point of entry for the fluid, the vessel usually has walls that are cylindrical. The walls may remain cylindrical over the entire length of the vessel, though it is more common for a portion of the vessel to be conically shaped. Nevertheless, as used herein the term "generally cylindrical" as applied to the walls of a hydrocyclone is intended to include such side walls as are wholly or partially cylindrical.

Hydrocyclones may be used successfully for dewatering a coarse suspension or for making a size separation between the particulates in the suspension. In this case the device is called a classifying hydrocyclone. Equally important, however, is the potential for the use of hydrocyclones for gravity separation. Hydrocyclones have been used extensively as gravity separators in coal preparation plants. Design features have been established for such applications which emphasize the difference in the specific gravity of particles rather than differences in particle size.

One of the types of hydrocyclones used for gravity separation has four inlet/outlet ports and consists of a straight-wall cylindrical vessel that may be operated at various inclination ranging from horizontal to vertical. A fluid particulate suspension, or slurry, enters the vessel through a coaxial feed pipe, generally at the upper end of the vessel. A second fluid, typically water or a heavy media suspension, is injected under pressure tangentially into the vessel through an inlet adjacent the lower end of the vessel. The second fluid mixes with the fluid particulate suspension and creates a completely open vortex within the vessel as it transverses the length of the vessel toward a tangential reject discharge adjacent the upper end. The cyclonic action in the vessel separates the heavier particles from the fluid mixture for removal from the vessel through a coaxial outlet or vortex finder at the lower end of the vessel.

(c) Air Sparged Hydrocyclone Separator

The principals of air-induced flotation separation may be employed in the environment of the hydrocyclone. The result is the air-sparged hydrocyclone.

In air-sparged hydrocyclone flotation, a separator vessel is employed having generally cylindrical walls. Portions or all of those walls are porous and surrounded on the outside thereof by an air plenum. Through this structure, pressurized air broken into small bubbles can be introduced into the separator vessel through the walls thereof. Alternately, but toward the same end, air in the form of small bubbles can be introduced into the particle suspension in other manners, such as by injecting air into the feed stream of the particle suspension before it reaches the separation vessel.

The slurry is fed into the separator vessel tangentially to the walls thereof through a conventional cyclone header. A forced vortex swirl flow develops on the inside surface of porous walls of the separator vessel. Pressurized air passes through the jacketed porous walls entering the separator vessel and is sheared into numerous small bubbles by the swirl flow of the slurry. Hydrophobic particles in the slurry collide with these bubbles, attaching to form particle/bubble aggregates. After attachment, the particle/bubble aggregates, have a relatively low specific gravity. The aggregates lose their tangential momentum and migrate radially inwardly to the center of the separator vessel, there forming a froth. This process is described in additional detail in U.S. Pat. Nos. 4,279,743, 4,397,741, 4,399,027, 4,744,890 and 4,834,434, which are incorporated herein by reference.

The froth is stabilized and constrained from sagging into the outlet area of the separator vessel by a froth pedestal. The froth continues to be generated, moving axially in the separator vessel towards a vortex finder at the end of the separator vessel opposite the froth pedestal. The froth is discharged through the vortex finder as an overflow product. Most hydrophilic particles remain in the slurry and are discharged together therewith as an underflow product through the annulus created between the sides of the froth pedestal and the wall of the separator vessel.

With such a design, effective flotation is possible that requires only a short retention time in the air-sparged hydrocyclone. For a typical design, the specific capacity of the air-sparged hydrocyclone separator is 100 to 600 tpd to per cubic foot of cell volume. As a result of such a high processing capacity, the retention time in an air-sparged hydrocyclone separator is very short, less than one second for the nominal two-inch diameter system. Despite such a high specific capacity, however, the flotation separation efficiency, that is the purity of the flotation froth product, may be difficult to sustain in certain cases.

Although most hydrophilic particles are rejected through the underflow annulus, some of these particles, which are usually gangue particles, inevitably migrate into the froth and are thus discharged together with hydrophobic particles through the vortex finder. This disadvantageously lowers the grade or purity of the froth product. In a short retention time, it is difficult to remove all these undesirable, entrapped hydrophilic particles from the froth product.

BRIEF SUMMARY OF THE INVENTION

One object of the present invention is to produce an improved air sparged hydrocyclone separator.

Another object of the present invention is to produce such a separator in which the purity of the output froth is enhanced relative to known separators without increasing the retention time required of the slurry processed therein.

Yet another object of the present invention is to provide a method and apparatus by which hydrophilic particles entrained in a foam of hydrophobic particle/bubble aggregates may be scrubbed therefrom.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as broadly described herein, an apparatus is provided for effecting flotation separation of hydrophobic particles from a fluid suspension containing both hydrophobic and hydrophilic particles. The apparatus comprises a separation vessel having generally cylindrical sides in combination with an inlet and an outlet at opposite ends thereof. The fluid suspension is injected into the separation vessel through the inlet tangentially to the interior of the sidewalls thereof, thereby to create from the fluid suspension a forced vortex swirl against the inner surface of those sides. A fluid discharge comprising an output portion of the fluid suspension in the swirl flow from which hydrophobic particles have been substantially removed by flotation is directed from the separation vessel through the outlet thereof.

Air bubbles are introduced into the fluid suspension. This can be accomplished using a jacketed porous wall portion of the sides of the separation vessel through which air is introduced directly into the fluid suspension in the swirl flow. The resulting air bubbles collide with and attach to hydrophobic particles, which then separate from the fluid suspension and the swirl flow to form a froth at the center of the separation vessel. A froth pedestal may be centered at the bottom of the separation vessel to support the froth and prevent its mixing with the fluid discharge. The froth is removed from the separation vessel through a vortex finder located at the end thereof opposite from the froth pedestal.

Means are provided for purifying the froth of hydrophilic particles entrained therein before the froth is removed from the separation vessel. A froth washing tube is utilized to discharge pressurized water into the separation vessel. In one embodiment the froth washing tube terminates proximate to the upper end of the separation vessel, and where the froth washing tube terminates in an open end the pressurized water is discharged therethrough.

Means are provided for spraying the pressurized water radially outwardly from the froth washing tube toward the side walls of the separation vessel. This displaces water in the froth radially outwardly in the separation vessel carrying with it hydrophilic particles. These return to the slurry for discharge from the separation vessel as a fluid discharge.

In one embodiment, the means for spraying comprises a deflector located opposite the open end of the froth washing tube in a position to be impacted by pressurized water discharged therefrom. The deflector causes the momentum of the pressurized water to be directed radially outward from the open end of the froth washing tube. The deflector may comprise a plate mounted opposite the open end of the froth washing tube in a plane generally normal to the longitudinal axis of the separation vessel. The surface of the deflector impacted by the pressurized water is a curved surface that is rotationally symmetric about the longitudinal axis of the froth washing tube at the open end thereof. Where a froth pedestal is employed, the froth washing tube may pass therethrough and be disposed interior to the separation vessel coaxially therewith.

Alternatively, or in combination therewith, where the froth washing tube is disposed interior to and concentrically the separation vessel, spray apertures may be used along the length of the tube through which to introduce water into the separation vessel.

The present invention also contemplates a method for the flotation separation of hydrophobic particles from a fluid suspension containing both hydrophobic and hydrophilic particles. The method comprises the steps of providing a separation vessel having generally cylindrical side walls. Typically at least a portion of the side walls are porous and jacketed by an air plenum. The fluid suspension is injected into the separation vessel generally tangentially to the cylindrical side walls in such a manner that the fluid suspension swirls about the inner surface of the side walls in a thin layer to create a forced vortex swirl. Air is sparged through the side walls of the separation vessel into the thin layer of fluid to form small bubbles to which the hydrophobic particles attach and separated from the fluid suspension into a froth at the center of the separation vessel.

The method of the present invention further includes the steps of removing the froth from a first end of the separation vessel and discharging pressurized water into the separation vessel through a froth washing tube terminating proximate to the first end of the separation vessel in an open end through which the pressurized water is discharged. That water is sprayed from the open end of the froth washing tube through the froth radially outwardly from the froth washing tube toward the side walls of the separation vessel. Passing through the froth the water causes hydrophilic particles entrained in the froth to return to the swirl flow on the walls of the separation vessel.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Reference is now made to the drawings wherein like parts are designated with like numerals throughout. It will be readily appreciated that the components of the present invention as generally described and illustrated in the figures herein could be arranged and described in a wide variety of different configurations.

Figure 1:
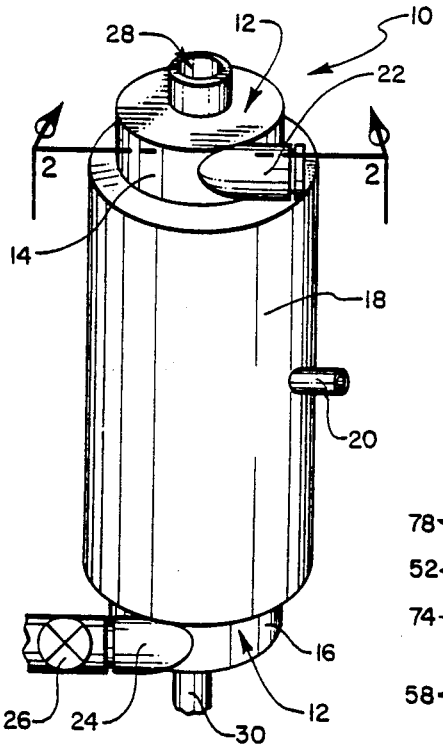
FIG. 1 is a perspective view of one embodiment of an air-sparged hydrocyclone separator incorporating teachings of the present invention.

FIG. 1 illustrates one embodiment of a hydrocyclone separator 10 embodying teachings of the present invention to effect flotation separation of hydrophobic particles from a fluid suspension containing both hydrophobic and hydrophilic particles. Hydrocyclone separator 10 has a generally cylindrical configuration, which in the embodiment illustrated in FIG. 1 is shown as being oriented with the longitudinal axis thereof in a vertical direction. Hydrocyclone separator 10 comprises a centrally disposed separation vessel 12 encircled between upper end 14 and lower end 16 thereof by an air plenum 18. Separation vessel 12 has generally cylindrical side walls. In the portion of separation vessel 12 encircled by air plenum 18 the cylindrical side walls are porous to permit air entering air plenum 18 through an air inlet port 20 to pass through the cylindrical side walls of separation vessel 12 to the interior thereof.

The slurry or fluid particulate suspension to be processed by hydrocyclone separator 10 enters thereinto through an inlet port 22 located at upper end 14 of separation vessel 12. The orientation of inlet port 22 relative to the cylindrical side walls of separation vessel 12 is such that the fluid suspension injected into separation vessel 12 through inlet port 22 is directed tangentially to the interior of those cylindrical side walls. This creates from the fluid suspension a forced vortex swirl against the inner surfaces of the cylindrical side walls. The forced vortex swirl flow of the fluid suspension circles the inner walls of separation vessel 12 under the influence of gravity in a descending manner from upper end 14 to lower end 16 thereof, or the incoming fluid suspension may be directed at a slight downward angle relative to the longitudinal axis separation vessel 12 to enhance this effect.

Flotation separation of the hydrophobic particles in the fluid suspension occurs during this forced vortex swirl flow. At lower end 16, separation vessel 12 is provided with an outlet port 24 through which to direct out of separation vessel 12 a fluid discharge comprising an output portion of the fluid suspension in the swirl flow from which hydrophobic particles have been substantially removed by flotation. Outlet port 24 may for optimum performance effectiveness be oriented tangentially to the side walls of separation vessel 12 similarly to inlet port 22. Outlet port 24 is provided with a fluid discharge control valve 26 for regulating the rate at which fluid is discharged therethrough. Alternate structures for removing the fluid discharge from separation vessel 12 will be disclosed in relation to subsequent embodiments of the invention.

Two features of hydrocyclone separator 10 appreciable from the exterior thereof require mention in order to complete a general orientation to the device. The first of these is a vortex finder 28 located at upper end 14 of separation vessel 12 concentrically with the longitudinal axis thereof. It is through vortex finder 28 that the hydrophobic particles from the fluid suspension injected through inlet port 22 are actually removed from the central region of separation vessel 12 in the form of a foam comprised of hydrophobic particle/bubble aggregates. Secondly, at lower end 16 of separation vessel 12 is a pressurized water inlet port 30 utilized according to the teachings of the present invention to introduce pressurized water into the device to scrub from the foam at the center of separation vessel 12 stray hydrophilic particles entrained therein.

Figure 2:
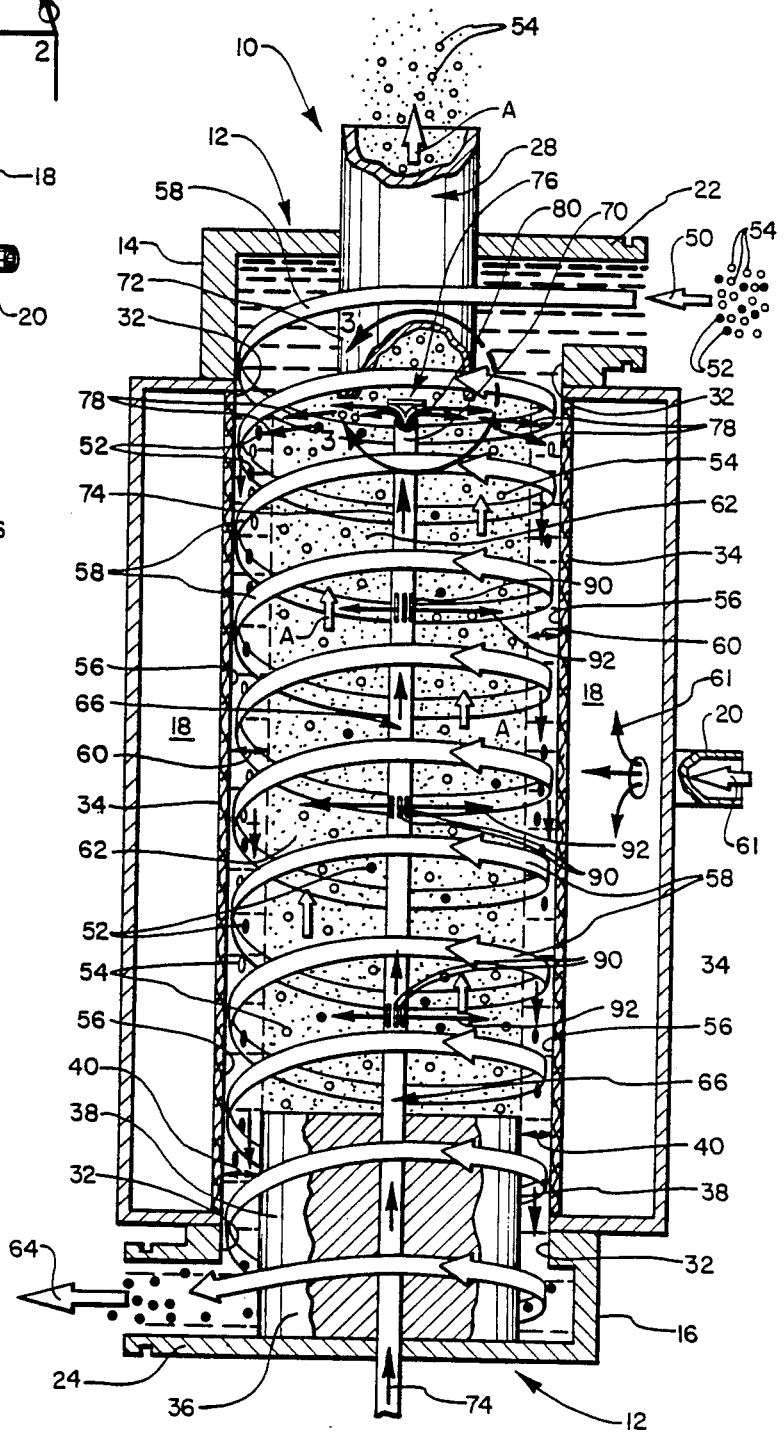
FIG. 2 is an elevational cross-sectional view of the apparatus of FIG. 1 taken along section line 2—2, shown therein and illustrating the operation of that apparatus in separating hydrophobic particles from a fluid particulate suspension containing both hydrophobic and hydrophilic particles.

The interaction of all of the components introduced above will be best understood through reference to FIG. 2. As seen therein, cylindrical side walls 32 of separation vessel 12 include between upper end 14 and lower end 16 thereof porous wall portions 34 through which air may enter separation vessel 20 from air plenum 18. Centered in lower end 16 of separation vessel 12 is a froth pedestal 36 of generally cylindrical shape. Alternate shapes for a froth pedestal, such as froth pedestal 36 will be disclosed in relation to subsequent embodiments of the invention. Between the sides 38 of froth pedestal 36 and side walls 32 of separation vessel 12 is formed an annular outlet passageway 40 that communicates at lower end 16 of separation vessel 12 with outlet port 24. Froth pedestal 36 functions to support the froth formed in the center of separation vessel 12 by the flotation process. In this manner, mixing of the froth with fluid discharge passing out of separation vessel 12 through annular outlet passageway 40 is minimized. In addition, by supporting the froth, froth pedestal 36 ensures that the formation of new froth in the separation process will tend to force froth already in the center of separation vessel 12 axially along separation vessel 12 for removal therefrom through vortex finder 28.

The operation of hydrocyclone separator 10 will now be explained. A fluid suspension 50 containing finely divided hydrophilic particles 52 (illustrated by dark-colored circles) and hydrophobic particles 54 (illustrated by light-colored circles) is injected into separation vessel 12 through inlet port 22.

Fluid suspension 50 is injected through inlet port 22. The force of injection is such as to cause fluid suspension 50 to spiral about the inner surface 56 of cylindrical side walls 32 and porous wall portion 34 following the course indicated by spiral arrows 58. In this process, fluid suspension 50 forms a forced vortex swirl flow in a thin layer 60 creating a strong centrifugal force field therein. The particles to be separated from fluid suspension 50 should either be naturally hydrophobic or rendered so by the addition of an appropriate promoter or collector. Other particles which may be present in fluid suspension 50, and which are not desired to be removed, should be maintained hydrophilic by addition of other suitable flotation reagents. As used herein, the term "hydrophobic particle" refers both to a particle that is naturally hydrophobic as well as to a particle that is rendered so through appropriate chemical treatment.

Air 61 introduced into air plenum 18 through air inlet port 20 passes through porous wall portions 34 into layer 60 of fluid suspension 50. The air forms small bubbles (not shown) which attach to and/or trap the hydrophobic particles 54 forming hydrophobic particle/bubble aggregates. These separate from fluid suspension 50 in layer 60 to form a froth 62 shown schematically by diagonal cross hatching at the central portion of separation vessel 12.

Froth pedestal 36 acts to minimize mixing between froth 62 and fluid suspension 50 as the latter enters annular outlet passageway 40 to be directed out of said separation vessel 12 as a fluid discharge 64 from which hydrophobic particles have been substantially removed by the flotation process. In addition, froth pedestal 36 supports froth 62, preserving its stability and integrity so that as additional froth is generated from layer 60 of fluid suspension 50, froth 62 migrates upwardly as shown in FIG. 2 away from froth pedestal 36 toward upper end 40 of separation vessel 12. There, froth 62 is removed from separation vessel 12 by passing toward and through vortex finder 28 in the direction shown by arrows A.

In one aspect of the present invention, means are provided for purifying a froth, such as froth 62, of any entrained hydrophilic particles before the froth is discharged from the separation vessel of a hydrocyclone separator. As shown by way of example and not limitation in FIG. 2, a froth washing tube 66 passes through froth pedestal 36 and is disposed within separation vessel 12 coaxially therewith. Froth washing tube 66 is coupled at one end to pressurized water inlet port 30 and terminates at the other in an open end 70 centrally located in close proximity to upper end 14 of separation vessel 12. As shown, open end 70 is thus located at the inner end 72 of vortex finder 28 interior to separation vessel 12. Pressurized water 74 passes through pressurized water inlet port 30 and froth washing tube 66 and is discharged therefrom into separation vessel 12 through open end 70 of froth washing tube 66.

According to another aspect of the present invention, means are provided for spraying pressurized water 74 in froth washing tube 66 radially outward therefrom toward side walls 32 of separation vessel 12. As shown by way of example and not limitation, a deflector in the form of a plate 76 is located opposite open end 70 of froth washing tube 66 in the position to be impacted by pressurized water 74 being discharged from froth washing tube 66.

Plate 76 causes the momentum of pressurized water 74 to be directed radially outwardly from open end 70 of froth washing tube 66 in a spray 78 that passes through froth 62. Spray 78 displaces water in froth 62 toward the walls of separation vessel 12. Any stray hydrophilic particles 52 entrained in froth 62 move with this displaced water or with spray 78 itself back into layer 60 of fluid suspension 50. There, the hydrophilic particles 52 are removed with the swirl flow of layer 60 as fluid discharge 64. Spray 78 thus serves to scrub impurities from froth 62 before its removal from separation vessel 12.

Figure 3:
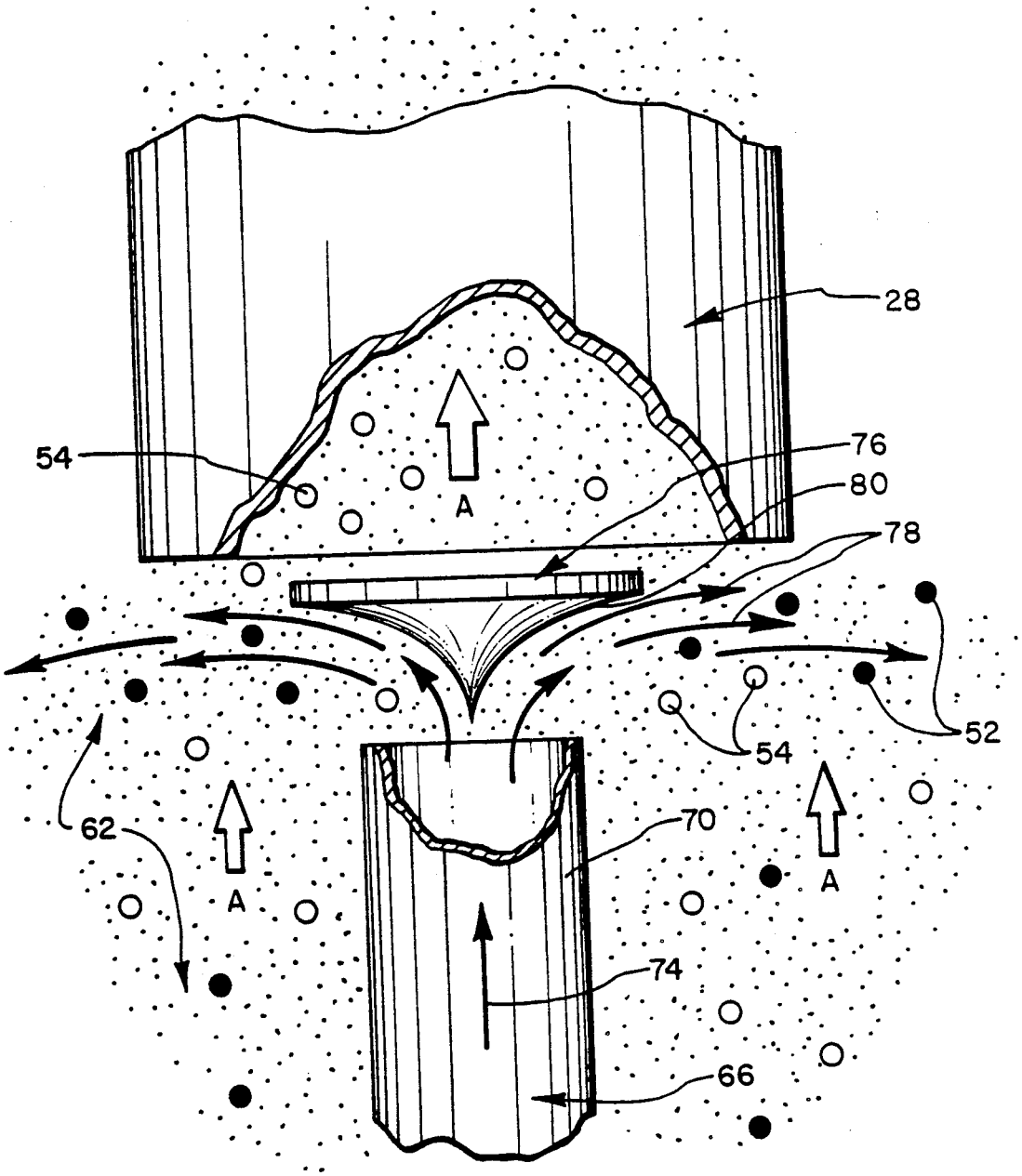
FIG. 3 is an enlarged elevational view of a portion of the apparatus shown in FIG. 2.

As seen in the detail view appearing in FIG. 3, plate 76 is mounted in a plane generally normal to the longitudinal axis of separation vessel 12. A lower surface 80 of plate 76 is impacted by pressurized water 74 discharged from froth washing tube 66. Lower surface 80 is both curved and symmetrical about the longitudinal axis of froth tube 76 at open end 70 thereof. In some instances, plate 76 may be attached directly to froth washing tube 66 at open end 70 thereof or supported from inner end 72 of vortex finder 28. Other structures for spraying pressurized water 74 through froth 62 are equally workable towards the ends of the present invention.

For example, it is not necessary to restrict the location at which pressurized water is sprayed through froth 62 to a location that is close to inner end 72 of vortex finder 28. Instead, as shown in FIG. 2, spray apertures 90 may be formed through froth washing tube 66 at various locations along the length thereof. Some pressurized water 74 then emerges from froth washing tube 66 through spray apertures 90 and is directed as spray 92 into and through froth 62. In the same manner as spray 78 created at open end 70 of froth washing tube 66, spray 92 serves to displace water from froth 66 toward the walls of separation vessel 12. With this displaced water or with spray 92 itself are carried hydrophilic particles which have been undesireably entrained in froth 62.

The cross section and orientation of spray apertures 90 is designed according to the effect desired. Thus, spray 92 emerging from spray apertures 90 could, for example, be a finely atomized mist, or a radially directed thin sheet. In addition to the configuration of spray apertures 90 themselves, inserts thereinto can be utilized to effect desired results. Where such inserts or the material of froth washing tube 66 itself is flexible, spray apertures 90 may comprise slits that, in the absence of pressurized water 74 within froth washing tube 66, are closed to prevent the entry of froth 62 thereinto, but which open when pressure is inside froth washing tube 66 to permit the emergence of pressurized water 74. Optionally, what has been designated as "open" end 70 of froth washing tube 66 can be closed so that all pressurized water 74 emerging from froth washing tube 66 does so through spray apertures 90.

It is generally recommended that spray, such as spray 72 or spray 78, have a high enough velocity so as to permit the water thereof to penetrate a substantial distance into froth 62. In the process, hydrophilic particles are entrained in the spray, or the spray displaces water in froth 62. This moves the water and any stray hydrophilic particles outwardly toward side walls 32 of separator vessel 12.

As froth 62 moves past spray 78 for removal from separation vessel 12, any hydrophilic particles 52 entrained as impurities therein are scrubbed therefrom. Accordingly, the apparatus and method of the present invention illustrated in FIGS. 1-3 maximize the purity of the froth output of a hydrocyclone separator, such as hydrocyclone separator 10. In this manner while maintaining a desirable low residence time for fluid suspension 50 in separation vessel 12, it is possible to use flotation principles to produce a froth output having a high degree of purity.

Figure 4:
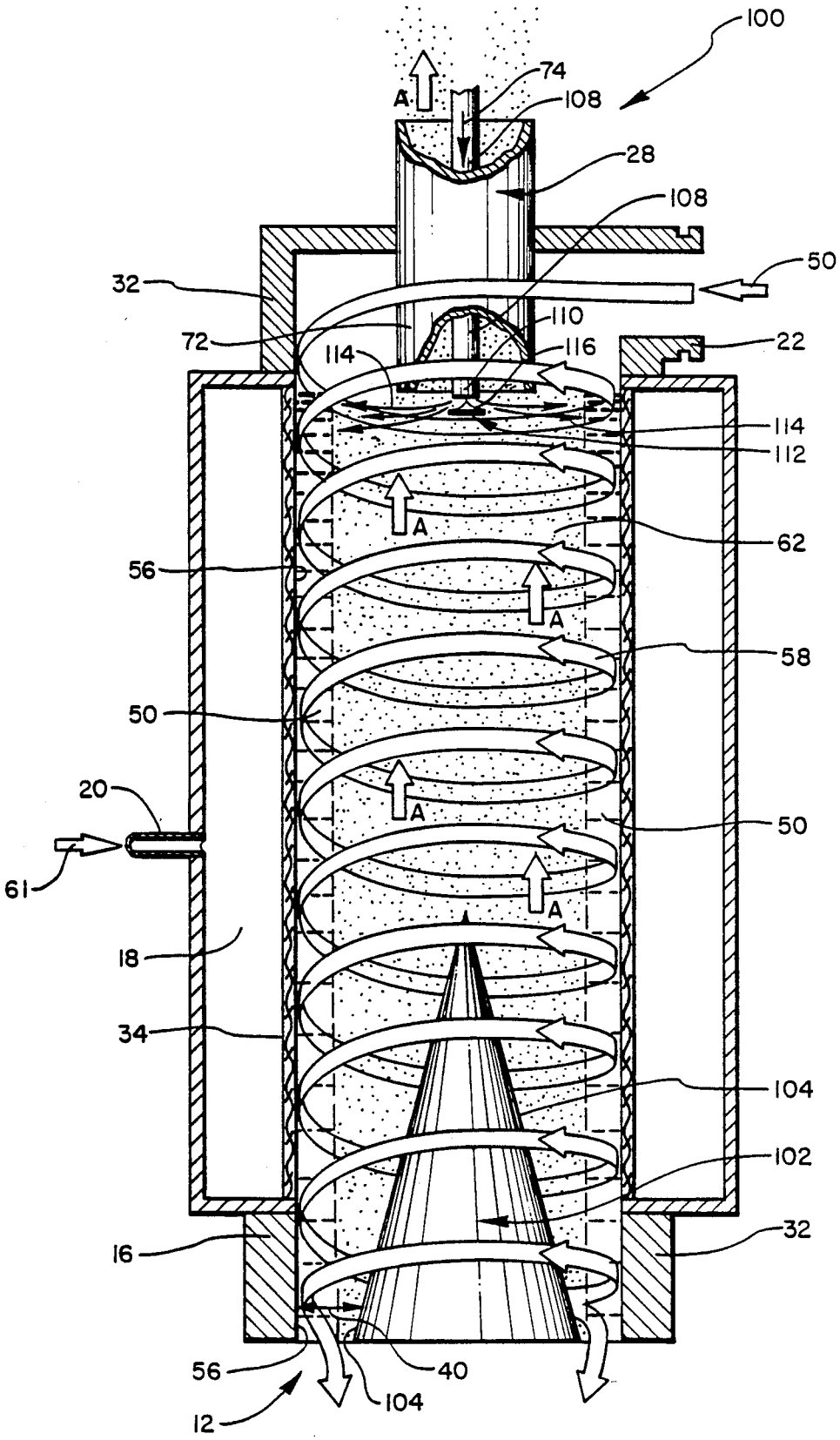
FIG. 4 is an elevational cross-sectional view of a second embodiment of an air-sparged hydrocyclone separator incorporating teachings of the present invention comparable to the view shown in FIG. 2.

A second embodiment of a hydrocyclone separator 100 incorporating teachings of the present invention is shown in FIG. 4. There similar structures to those found in hydrocyclone separator 10 of FIGS. 1-3 are identified by identical references. Only differing structure will be described hereinafter.

Hydrocyclone separator 100 includes at lower end 16 of separator vessel 12 a froth pedestal 102 of frustoconical configuration. Advantages inhering in a froth pedestal, having a configuration other than a cylindrical configuration are disclosed in U.S. Pat. No. 4,838,434.

An annular outlet passageway 40 is formed between the sides 104 of froth pedestal 102 and the inner surface 56 of side walls 32 of separator vessel 12 at lower end 16 thereof. Fluid discharge leaves separator vessel 12 through annulary outlet passageway 40 in a smooth-flowing fashion. Since the centrifugal flow of fluid suspension within separation vessel 12 moves around the inner surface 56 thereof, outlet passageway 40 provides a natural escape for fluid discharge, thereby allowing the fluid discharge to exit hydrocyclone separator 100 without disrupting fluid flow therewithin.

In accordance with the present invention, means are provided for purifying a froth, such as froth 62, of any entrained hydrophilic particles before froth 62 is discharged through vortex finder 28. As shown by way of example and not limitation, in FIG. 4 a froth washing tube 108 passes coaxially through vortex finder 28 to terminate in an open end 110. Open end 110 is thus located at the inner end 72 of vortex finder 28 interior to separation vessel 12. Pressurized water 74 passes through froth washing tube 108 in the direction indicated and is discharged therefrom into separation vessel 12 near inner end 72 of vortex finder 28.

According to yet another aspect of the present invention, means are provided for spraying pressurized water 74 that is discharged from open end 110 of froth washing tube 108 radially outwardly therefrom into or through froth 62 toward side walls 32 of separation vessel 12. As shown by way of example and not limitation, a deflector 112 in the form of a plate is located opposite open end 110 of froth washing tube 108 in a position that is impacted by pressurized water 74 being discharged therefrom.

As with plate 76, deflector 112 causes the momentum of pressurized water 74 to be directed radially outward from open end 110 of froth washing tube 108 in a spray 114 toward ends already disclosed above. Deflector 112 is mounted in a plane generally normal to the longitudinal axis of separation vessel 12. A lower surface 116 of deflector 112 is impacted by pressurized water 74. Lower surface 116 is both curved and symmetrical about the longitudinal axis of froth washing tube 108 at open end 110 thereof. In some instances, deflector 112 may be attached directly to froth washing tube 108 or supported from inner end 72 of vortex finder 28. Other structures for spraying pressurized water 74 through froth 62 are equally workable towards the ends of the present invention. As froth 62 moves past spray 114 prior to be removed from separation vessel 12, any hydrophilic 52 entrained as impurities therein are scrubbed therefrom. Accordingly, the apparatus and method of the present invention illustrated in FIG. 4 maximize the purity of the froth output of the hydrocyclone separator, such as hydrocyclone separator 100. In this manner, while maintaining a desirable low residence time for fluid suspension 50 in separation vessel 12, it is possible to use flotation principles to produce a froth output having a high degree of purity.

The effectiveness of an apparatus constructed according to the principles of the present invention in effecting this result has been demonstrated experimentally.

EXAMPLE 1

An air sparged hydrocyclone separator was employed toward the flotation separation of quartz from limestone in a fluid suspension containing 49 percent (49%) quartz with 1.0 kG/ton amine and 0.2 kg/ton MIBC. The rate of discharge of pressurized water 74 into separator vessel 12 was varied from no discharge at all, corresponding to an air-sparged hydrocyclone separator 10 lacking the foam scrubber feature of the present invention, to a rate of flow of pressurized water 74 in the range of about 4.0 lpm to about 4.5 lpm. The following results were observed.

TABLE I

| Pressurized Water l pm | Quartz Recovery Percent | Concentrate Grade % Quartz |
|---|---|---|
| 0 | 88.8 | 61.4 |
| 2.5–3.0 | 82.8 | 64.3 |
| 4.0–4.5 | 84.8 | 69.6 |
| Conditions: | ASH | 2 inch ID, 3 sections |
| | Vortex Finder | 0.8 inch |
| | Pedestal | 9.5% fraction of the radius of the cylindrical section |
| | Air Flow Rate | 200 uniform distribution |
| | Slurry | 20% solids |
| | Slurry Pressure | 5 psig |

The grade of concentrate recovered from the separator tested can be seen to bear a direct relationship to the volume of pressurized water utilized.

EXAMPLE 2

The principles of the present invention were applied to a plurality of air sparged separators to separate a low-grade feed of about a 15 percent talc suspension. With pressurized water supplied at the rate of 4.0 lpm, a talc recovery rate of about 50 percent to about 55 percent was achievable on each of the two devices listed below.

TABLE II

| Equipment | Concentration Grade, % Talc |
|---|---|
| Standard ASH-2C System | 56.0 |
| Froth Washer ASH-2C/FW System | 64.0 |

The concentrate grade achieved with the inventive froth scrubbing method exceeds the concentrate grade using prior art air-sparged hydrocyclones.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for flotation separation of hydrophobic particles from a fluid suspension containing both hydrophobic and hydrophilic particles, said apparatus comprising:

(a) a generally vertically oriented separation vessel having generally cylindrical side walls;

(b) a tangential inlet port means at the upper end of said separation vessel for injecting the fluid suspension into said separation vessel tangentially to the interior of said side walls to create from said fluid suspension a forced vortex swirl flow against the inner surface of said side walls;

(c) an outlet port means at the lower end of said separation vessel for directing out of said separation vessel a fluid discharge comprising an output portion of the fluid suspension in said swirl flow from which hydrophobic particles have been substantially removed by flotation;

(d) means for introducing air into said separation vessel and into the fluid suspension therein, the air forming bubbles to which hydrophobic particles attach and separate from the fluid suspension in said swirl flow to form a froth at the center of said separation vessel, said means for introducing air comprising:

(i) a porous wall portion of said side walls of said separation vessel; and (ii) an air plenum surrounding said porous wall portion of said side walls, the porous wall portion admitting air from the air plenum into the fluid suspension in said swirl flow;

(e) froth outlet means centrally located at the upper end of said separation vessel for removing from said separation vessel the froth at the center thereof; and (f) means for purifying said froth of entrained hydrophilic particles before said froth is removed from said separation vessel, said means for purifying comprising:

(i) a froth washing means for discharging pressurized water into said separation vessel, said froth washing means comprising a froth washing tube terminating proximate to said upper end of said separation vessel near the center thereof; and (ii) means for spraying the pressurized water radially outwardly from said froth washing tube toward said side walls of said separation vessel.

2. An apparatus as recited in claim 1, wherein said froth washing tube is disposed interior to and coaxially with said separation vessel.

3. An apparatus as recited in claim 2, wherein said means for spraying comprises at least one spray aperture formed through said froth washing tube along the portion thereof interior to said separation vessel, and wherein the cross section and orientation of said spray aperture is such as to direct said pressurized water radially outwardly from said froth washing tube into said froth toward said side walls of said separation vessel.

4. An apparatus as recited in claim 1, wherein said froth washing tube terminates proximate to said upper end of said separation vessel in an open end through which at least a portion of the pressurized water is discharged.

5. An apparatus as recited in claim 4, wherein said means for spraying comprises a deflector located opposite said open end of said froth washing tube in a position to be impacted by said pressurized water discharged therefrom, said deflector causing the momentum of said pressurized water to be directed radially outwardly from said open end of said froth washing tube into said froth toward said side walls of said separation vessel.

6. An apparatus as recited in claim 5, wherein said deflector comprises a plate mounted opposite said open end of said froth washing tube in a plane generally normal to the longitudinal axis of said separation vessel.

7. An apparatus as recited in claim 5, wherein said deflector is rotationally symmetrical about the longitudinal axis of said froth washing tube at said open end thereof.

8. An apparatus as recited in claim 7, wherein the surface of said deflector impacted by said pressurized water discharged from said froth washing tube is a curved surface.

9. An apparatus as recited in claim 1, further comprising a froth pedestal centered in said lower end of said separation vessel to support said froth and to prevent mixing between said froth and said fluid discharge, and wherein said froth washing tube passes through said froth pedestal and is disposed interior to and coaxially with said separation vessel, said froth washing tube terminating in an open end through which pressurized water is discharged into the separation vessel and wherein said means for spraying comprises a deflector located opposite said open end of said froth washing tube in a position to be impacted by said froth washing tube in a position to be impacted by pressurized water discharged therefrom, said deflector causing the momentum of said pressurized water discharged from said froth washing tube to be directed radially outwardly from said froth washing tube through said froth toward said side walls of said separation vessel.

10. An apparatus as recited in claim 9, wherein said deflector comprises a plate mounted opposite said open end of said froth washing tube in a plane generally normal to the longitudinal axis of said separation vessel.

11. An apparatus as recited in claim 10, wherein the surface of said deflector impacted by said pressurized water discharged from said open end of said froth washing tube is rotationally symmetric about the longitudinal axis of said froth washing tube.

12. An apparatus as recited in claim 1, wherein said froth outlet means comprises a vortex finder at said upper end of said separation vessel through which said froth is discharged from said separation vessel, and wherein said froth washing tube terminates proximate to the end of said vortex finder interior to said separation vessel.

13. An apparatus as recited in claim 12, wherein said froth washing tube is disposed interior to and coaxially with said separation vessel.

14. An apparatus as recited in claim 13, wherein said means for spraying comprises at least one spray aperture formed through said froth washing tube along the portion thereof interior to said separation vessel, and wherein the cross section and orientation of said spray aperture is such as to direct said pressurized water radially outwardly from said froth washing tube into said froth toward said side walls of said separation vessel.

15. An apparatus as recited in claim 12, wherein said froth washing tube terminates proximate to said upper end of said separation vessel in an open end through which at least a portion of the pressurized water is discharged.

16. An apparatus as recited in claim 12, wherein said froth washing tube is disposed interior to and coaxially with said vortex finder.

17. An apparatus as recited in claim 16, wherein said means for spraying comprises a deflector located opposite said open end of said froth washing tube in a position to be impacted by said pressurized water discharged therefrom, said deflector plate causing the momentum of said pressurized water to be directed radially outwardly from said open end of said froth washing tube through said froth.

18. An apparatus as recited in claim 17, wherein said deflector comprises a plate mounted opposite said open end of said froth washing tube in a plane generally normal to the longitudinal axis of said separation vessel.

19. An apparatus as recited in claim 18, wherein the surface of said deflector plate impacted by said pressurized water discharged from said open end of said froth washing tube is a curved surface rotationally symmetric about the longitudinal axis of said froth washing tube at the open end thereof.

20. An apparatus as recited in claim 19, further comprising a froth pedestal centered in said lower end of said separation vessel to support the froth and to prevent mixing between the froth and the fluid discharged.

21. An apparatus as recited in claim 20, said froth pedestal is cylindrical in shape.

22. An apparatus as recited in claim 20, said froth pedestal is conical in shape.

23. An apparatus as recited in claim 20, wherein said froth washing tube passes through said froth pedestal and is disposed interior to and coaxially with said separation vessel.

24. An apparatus for flotation separation of hydrophobic particles from a fluid suspension containing both hydrophobic and hydrophilic particles, said apparatus comprising:

(a) a separation vessel having generally cylindrical side walls;

(b) a tangential inlet port means at a first end of said separation vessel for injecting the fluid suspension into said separation vessel to create from said fluid suspension a forced vortex swirl flow against the inner surface of said side walls;

(c) an outlet port means at a second end of said separation vessel opposite said first end thereof for directing out of said separation vessel a fluid discharge comprising an output portion of the fluid suspension in said swirl flow from which the hydrophobic particles have been substantially removed by flotation;

(d) a jacketed porous wall portion of said side walls of said separation vessel;

(e) means for introducing air bubbles into said fluid suspension in said swirl flow through said porous wall portion, hydrophobic particles attaching to the air bubbles and separating from the fluid suspension in said swirl flow to form a froth at the center of said separation vessel;

(f) a vortex finder located coaxially with said separation vessel at said first end thereof, said froth being removed from said separation vessel through said vortex finder;

(g) a froth pedestal centered in said second end of said separation vessel; and (h) means for purifying said froth of entrained hydrophobic particles before said froth is removed through said vortex finder, said means for purifying comprising:

(i) a froth washing means for discharging pressurized water into said separation vessel, said froth washing means comprising a froth washing tube terminating interior to said separation vessel opposite said vortex finder in an open end through which the pressurized water is discharged; and (ii) means for spraying said pressurized water discharged from said open end of froth washing tube radially outwardly therefrom through said froth toward said side walls of said separation vessel.

25. An apparatus as defined in claim 24, wherein said means for spraying comprises a deflector located opposite said open end of said froth washing tube in a position to be impacted by said pressurized water discharged therefrom, said deflector causing fluid discharged from said froth washing tube to be directed to strike said side walls of said separation vessel about the full circumference thereof.

26. An apparatus as recited in claim 25, wherein said deflector comprises a plate mounted opposite said open end of said froth washing tube in a plane generally normal to the longitudinal axis of said separation vessel.

27. An apparatus as recited in claim 25, wherein said deflector is rotationally symmetrical about the longitudinal axis of said froth washing tube at said open end thereof.

28. An apparatus as recited in claim 27, wherein the surface of said deflector impacted by said pressurized water discharged from said froth washing tube is a curved surface.

29. An apparatus as recited in claim 24, wherein said froth washing tube is disposed interior to and coaxially with said separation vessel.

30. In an apparatus for flotation separation of hydrophobic particles from a fluid suspension containing both hydrophobic and hydrophilic particles, the apparatus including a separation vessel having generally cylindrical side walls and opposed first and second ends, an inlet port at the first end of the separation vessel for introducing the fluid suspension to create therefrom a forced vortex flow against the inner surface of the side walls of the separation vessel, a jacketed porous wall portion of said side walls of said separation vessel, and means for introducing, though said porous wall, and into the swirl flow, air bubbles to which hydrophobic particles attach and separate from the fluid suspension in the swirl flow to form a froth at the center of said separation vessel for removal from the first end thereof, the improvement comprising:

(a) froth outlet means centrally located at the first end of said separation vessel for removing from said separation vessel the froth at the center thereof;

(b) a froth washing means for discharging pressurized water into the separation vessel, said froth washing means comprising a froth washing tube terminating interior to the separation vessel proximate to the center of the first end of the separation vessel in open end through which the pressurized water is discharged; and (c) means for spraying said pressurized water discharged from said open end of froth washing tube radially outwardly therefrom through the froth toward the side walls of the separation vessel; and (d) means at the second end of the vessel for directing out of said separation vessel a fluid discharge comprising an output portion of the fluid suspension in said swirl flow from which the hydrophobic particles have been substantially removed.

31. An apparatus as recited in claim 30, wherein said means for spraying comprises a deflector located opposite said open end of said froth washing tube in a position to be impacted by pressurized water discharged therefrom, said deflector causing the momentum of said pressurized water discharged from said froth washing tube to be directed radially outwardly from said froth washing tube through the froth toward the side walls of the separation vessel.

32. An apparatus as recited in claim 31, further comprising a froth pedestal centered in a second end of the separation vessel opposite the first end thereof, and wherein said froth washing tube passes through said froth pedestal and is disposed interior to and coaxially with the separation vessel.

33. An apparatus as recited in claim 32, wherein said deflector comprises a plate mounted opposite said open end of said froth washing tube in a plane generally normal to the longitudinal axis of the separation vessel.

34. An apparatus as recited in claim 33, wherein the surface of said deflector impacted by said pressurized water discharged from said open end of said froth washing tube comprises a curved surface rotationally symmetric about the longitudinal axis of said froth washing tube.

35. An apparatus as recited in claim 30, wherein said froth outlet means comprises a vortex finder at the first end of the separation vessel through which the froth is removed from the separation vessel, and wherein said means for spraying comprises a deflector located opposite said open end of said froth washing tube in a position to be impacted by said pressurized water discharged therefrom, said deflector plate causing the momentum of said pressurized water to be directed radially outwardly from said open end of said froth washing tube through the froth.

36. An apparatus as recited in claim 35, wherein said deflector comprises a plate mounted opposite said open end of said froth washing tube in a plane generally normal to the longitudinal axis of the separation vessel.

37. An apparatus as recited in claim 36, wherein the surface of said deflector plate impacted by said pressurized water discharged from said open end of said froth washing tube comprises a curved surface rotationally symmetric about the longitudinal axis of said froth washing tube at the open end thereof.

38. An apparatus as recited in claim 37, further comprising a froth pedestal centered in a second end of the separation vessel opposite the first end thereof, and wherein said froth washing tube passes through said froth pedestal and is disposed interior to coaxially with the separation vessel.

39. A method for flotation separation of hydrophobic particles from a fluid suspension containing both hydrophobic and hydrophilic particles, the method comprising the steps of:

(a) providing a separation vessel having generally cylindrical side walls, at least a portion of said side walls being porous and jacketed by an air plenum;

(b) injecting the fluid suspension into said separation vessel generally tangentially to said side walls thereof to crate from the fluid suspension a forced vortex swirl flow against the inner surface of said side walls of said separation vessel;

(c) sparging air through said porous portion of said side walls into said swirl flow, the air forming small bubbles to which the hydrophobic particles from the fluid suspension attach and separate from the fluid suspension in said swirl flow to form a froth at the center of said separation vessel;

(d) removing said froth from one end of said separation vessel;

(e) purifying the froth of entrained hydrophobic particles as the froth is discharged from said separation vessel, said step of purifying comprising the steps of:

(i) discharging pressurized water into said separation vessel through a froth washing tube terminating proximate to the center of the upper end of said separation vessel in an open end through which said pressurized water is discharged; and (ii) spraying said pressurized water radially outwardly from said open end of said froth washing tube through said froth toward said side walls of said separation vessel; and (f) removing from a second end of said vessel a fluid discharge comprising a portion of said swirl flow from which the hydrophobic particles have substantially been removed.

40. A method as defined in claim 39, wherein said step of spraying comprises the step of locating a deflector at said open end of said foam washing tube in a position to be impacted by said pressurized water discharged therefrom.

41. A method as defined in claim 39, wherein the surface of said deflector impacted by said pressurized water discharged from said froth washing tube comprises a curved surface rotationally symmetric about the longitudinal axis of said froth washing tube at the opening thereof.

42. In a method for flotation separation of hydrophobic particles from a fluid suspension containing both hydrophobic and hydrophilic particles wherein the fluid suspension is introduced into a separation vessel having generally cylindrical side walls in such a manner that the fluid suspension swirls about an inner surface of the side walls in a thin layer to create a forced vortex swirl flow and air is sparged through the side walls of the separation vessel into the thin layer of fluid to form small bubbles to which the hydrophobic particles attach and separate from the fluid suspension into a froth at the center of said separation vessel, the improvement comprising the steps of:

(a) removing said froth from a first end of said separation vessel;

(b) discharging pressurized water into said separation vessel through a froth washing tube terminating proximate to said first end of said separation vessel near the center thereof in an open end through which the pressurized water is discharged; and (c) spraying said pressurized water discharged from said open end of said froth washing tube through said froth radially outwardly therefrom toward said side walls of said separation vessel.

43. A method as recited in claim 42, wherein said step of spraying comprises the step of locating a deflector at said open end of said foam washing tube in a position to be impacted by said pressurized water discharged therefrom.

44. A method as recited in claim 43, wherein the surface of said deflector impacted by said pressurized water discharged from said froth washing tube comprises a curved surface rotationally symmetric about the longitudinal axis of said froth washing tube at said open end thereof.

* * * * *

UNITED STATES PATENT AND TRADEMARK OFFICE

CERTIFICATE OF CORRECTION

PATENT NO. : 4,997,549

DATED : March 5, 1991

INVENTOR(S) : RONALD L. ATWOOD

It is certified that error appears in the above-identified patent and that said Letters Patent is hereby corrected as shown below:

Column 1, line 27, after "or" insert --are--
Column 1, line 33, "nonsulphide" should be --nonsulfide--
Column 2, line 3, after "and" insert --to be--
Column 3, line 18, "inclination" should be --inclinations--
Column 3, line 33, "principals" should be --principles--
Column 4, line 11, delete "to"
Column 5, line 61, after "and" insert --are--
Column 9, line 40, "undesireably" should be --undesirably--
Column 11, line 1, "prior to be" should be --prior to being--
Column 15, line 53, "though said porous wall" should be --through the porous wall--
Column 15, line 54, after "flow" delete ","

Column 16, lines 32-33, "symmetric" should be --symmetrical--
Column 16, line 54, "symmetric" should be --symmetrical--
Column 16, line 60, after "to" insert --and--
Column 17, line 39, "symmetric" should be -- symmetrical
Column 18, line 36, "symmetric" should be --symmetrical--

Signed and Sealed this

First Day of December, 1992

*Attest:*

DOUGLAS B. COMER

*Attesting Officer*

*Acting Commissioner of Patents and Trademarks*